US009390660B2

(12) United States Patent
Johnson et al.

(10) Patent No.: US 9,390,660 B2
(45) Date of Patent: Jul. 12, 2016

(54) IMAGE CONTROL FOR DISPLAYS

(75) Inventors: Lewis Johnson, Delta (CA); Peter Longhurst, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1 day.

(21) Appl. No.: 13/383,621

(22) PCT Filed: Jul. 15, 2010

(86) PCT No.: PCT/US2010/042052

§ 371 (c)(1), (2), (4) Date: Jan. 12, 2012

(87) PCT Pub. No.: WO2011/011250

PCT Pub. Date: Jan. 27, 2011

(65) Prior Publication Data

US 2012/0120096 A1 May 17, 2012

Related U.S. Application Data

(60) Provisional application No. 61/228,427, filed on Jul. 24, 2009.

(51) Int. Cl.

| | |
|---|---|
| ***G09G 5/02*** | (2006.01) |
| ***G09G 3/34*** | (2006.01) |
| *G09G 3/20* | (2006.01) |
| *G09G 3/36* | (2006.01) |

(52) U.S. Cl.

CPC ..... *G09G 3/3426* (2013.01); *G09G 3/2048* (2013.01); *G09G 3/2003* (2013.01); *G09G 3/3611* (2013.01); *G09G 5/02* (2013.01); *G09G 2320/0242* (2013.01); *G09G 2320/0276* (2013.01); *G09G 2320/0646* (2013.01); *G09G 2320/0666* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 7,098,927 | B2 | 8/2006 | Daly | |
| 7,400,779 | B2 | 7/2008 | Daly | |
| 7,424,168 | B2 | 9/2008 | Daly | |
| 2005/0276502 | A1 * | 12/2005 | Brown Elliott et al. | 382/254 |
| 2006/0038826 | A1 | 2/2006 | Daly | |
| 2006/0145979 | A1 * | 7/2006 | Lee et al. | 345/88 |
| 2006/0221095 | A1 * | 10/2006 | Xu et al. | 345/593 |

(Continued)

FOREIGN PATENT DOCUMENTS

| | | |
|---|---|---|
| WO | 02/069030 | 9/2002 |
| WO | 03/077013 | 9/2003 |
| WO | 2006/010244 | 2/2006 |

OTHER PUBLICATIONS

Rempel, et al., "Ldr2Hdr: On-the-fly Reverse Tone Mapping of Legacy Video and Photograph", ACM Transactions on Graphics, vol. 26, No. 3, 39, Jul. 2007, pp. 1-6, New York, USA.

(Continued)

*Primary Examiner* — Xiao Wu
*Assistant Examiner* — Yu Chen

(57) ABSTRACT

Displays such as televisions, computer monitors, and the like may boost (124) the dynamic range of input image data (121). Dithering (128) may be provided to mitigate artefacts made visible as a result of the boosting. Color correction (124) may be implemented. The color correction may compensate for differences between a color of a backlight and a desired white point.

20 Claims, 10 Drawing Sheets

(56) References Cited

U.S. PATENT DOCUMENTS

| | | | | |
|---|---|---|---|---|
| 2007/0035706 | A1* | 2/2007 | Margulis | 353/122 |
| 2007/0035707 | A1* | 2/2007 | Margulis | 353/122 |
| 2007/0146382 | A1* | 6/2007 | Miller | 345/589 |
| 2008/0007565 | A1* | 1/2008 | Nogawa et al. | 345/597 |
| 2009/0009456 | A1 | 1/2009 | Ohshima | |
| 2010/0135575 | A1* | 6/2010 | Guo et al. | 382/164 |
| 2011/0188744 | A1* | 8/2011 | Sun | G06T 5/50 382/162 |
| 2011/0193610 | A1 | 8/2011 | Longhurst | |
| 2011/0193895 | A1 | 8/2011 | Johnson | |
| 2011/0193896 | A1 | 8/2011 | Johnson | |

OTHER PUBLICATIONS

Akyuz, et al., "Do HDR Displays Support LDR Content? A Psychophysical Evaluation", ACM Transactions on Computer Graphics, vol. 26, No. 3, 38, Jul. 2007, pp. 1-7, New York, USA.

* cited by examiner

IMAGE CONTROL FOR DISPLAYS

CROSS-REFERENCE TO RELATED APPLICATIONS

This application claims priority to U.S. Patent Provisional Application No. 61/228,427, filed 24 Jul. 2009, hereby incorporated by reference in its entirety.

TECHNICAL FIELD

This invention relates to displays such as computer displays, televisions, video monitors, home cinema displays, specialized displays such as displays used in medical imaging, virtual reality, vehicle simulators, and the like. The invention has particular application to displays having a spatial light modulator that modulates light from a light source. In some embodiments the light source has an output that is locally controllable.

BACKGROUND

Displays have become ubiquitous. There is increasing interest in providing displays that provide high quality images. Characteristics of high quality images include accurate color rendering and high dynamic (luminance) range. Displays capable of displaying high dynamic range images are known as high dynamic range displays.

Many displays display color digital images specified by input signals. Color digital images are made of pixels, and pixels are made of combinations of components, typically combinations of primary color components (e.g. Red-Green-Blue) or of a luminance component and chrominance components (e.g. YUV). The components that make up an image define a color space. A channel in this context is an image made of just one component, which varies in intensity over the image. The part of a channel that contributes to a pixel of a color image may be known as a sub-pixel.

Because input signals have finite bandwidth, the components of digital images are represented as discrete levels within finite ranges. As a result, the number of possible combinations of components is also discrete. The discrete representation of components causes the set of possible colors corresponding to combinations of the components, known as the gamut, to be limited in both depth (how finely levels of color can be expressed) and range (how broad a range of colors can be expressed).

Displays display color images by emitting colored light. Displays typically generate a range of colored light by combining light of different component colors. Displays that generate a range of colors of light by combining component colored light can display colors in a gamut defined by the component colored light. The gamut will be defined by the maximum intensity of each component colored light, and the depth of intensity of each component colored light. In some displays component colored light is emitted from pixels of a spatial light modulator that is illuminated by a backlight. In some displays, component color light is controlled digitally, for example by digital driving values. The gamuts of these displays are finite and discrete.

It is often the case that the gamut of a display will differ from the gamut of input signals that provide images to the display. The display gamut may differ from the input gamut in both depth (how finely levels of color can be expressed) and range (how broad a range of colors can be expressed). In order for the display to display a high quality image, the specification of the image for the input gamut must be transformed to specify the image for the display gamut. This transformation may require adjusting the image specification to provide increased depth or decreased depth, and/or to provide increased range or decreased range. By way of example only, an image specified for an input gamut with a range that is lower than the range of the gamut of a display may be adjusted for the higher-range gamut of the display.

The process of transforming an image specification from an input gamut to a display gamut provides an opportunity to optimize the image for display on the display. In particular, transforming the image specification may comprise increasing the dynamic range and the color depth of the image. However, increasing the dynamic range and the color depth of the image can introduce negative image characteristics, such as color shifts, posterization and visible contrast artefacts.

There is a general desire to provide displays capable of displaying high-dynamic range images. There is a general desire to adapt image data signals for high dynamic range display. There is a general desire to provide systems and methods for ameliorating and/or overcoming negative image characteristics associated with adapting image data signals for high dynamic range display.

SUMMARY

Aspects of the invention provide displays, methods for displaying images, methods for processing image data for display, image processing components for use in displays, and display controllers. Some embodiments provide color correction features. Some embodiments provide features for boosting dynamic range of displayed images. Such embodiments may comprise features for reducing artefacts resulting from boosting the dynamic range of image data.

Further aspects of the invention and features of specific embodiments of the invention are described below.

BRIEF DESCRIPTION OF DRAWINGS

The accompanying drawings illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. For example, certain known details of specification of color images and known details of methods for translating of color spaces and gamut mapping are not described herein. Such details are known to those of skill in the field and are described in the relevant literature and there is no need to repeat them here.

Accordingly, the specification and drawings are to be regarded in an illustrative, rather than a restrictive, sense.

Figure 1:
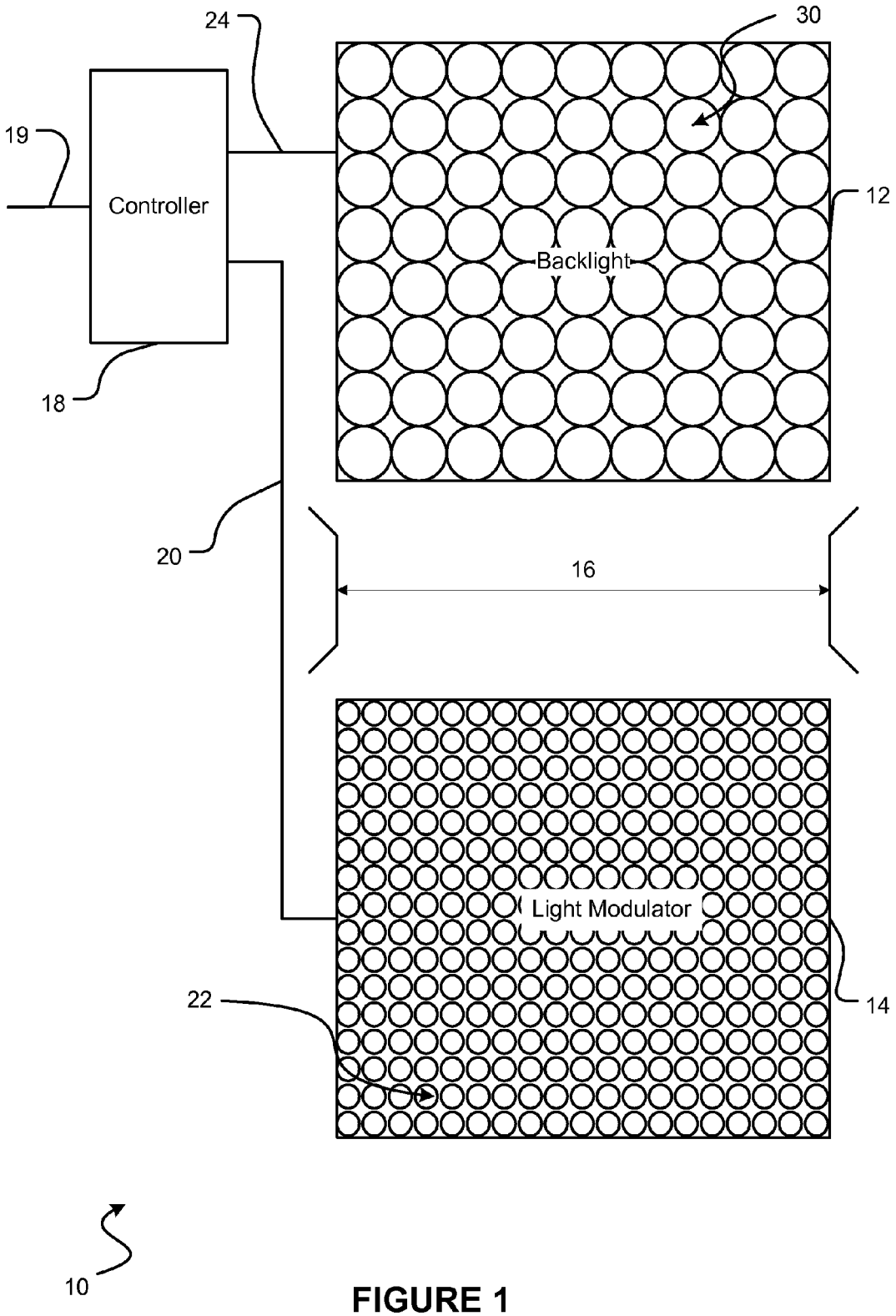
FIG. 1 is a schematic view of a display.

FIG. 1 shows schematically a display 10. Display 10 has a backlight 12 that is operable to emit light. Light from backlight 12 is delivered to a spatial light modulator 14 by way of an optical path 16. Optical path 16 may comprise optical elements such as one or more lenses, mirrors, prisms, diffusers, collimators, optical cavities, light guides, free space transmission paths, combinations thereof, and the like. In a simple embodiment, backlight 12 and spatial light modulator 14 are parallel and juxtaposed such that light emitted by backlight 12 falls directly onto spatial light modulator 14.

Display 10 comprises a controller 18. Controller 18 receives input signals 19 and generates output signals 20 that supply driving values for pixels 22 of spatial light modulator 14. Pixel driving values determine what proportion of the light incident on pixels 22 from backlight 12 is passed on (transmitted or reflected) to a viewing area. The response of pixels 22 to pixel driving values may be linear or non-linear. A response function specifies a relationship between the light that is passed by a pixel and pixel driving values. In general, a desired pixel driving value may be specified as the output of a response function of the desired passing of light.

Some embodiments comprise such response functions. A response function may be embodied as a look-up table (LUT); code providing an algorithm to be executed on a processor; logic circuits (which may be configurable or hardwired), combinations thereof, or the like.

In general, spatial light modulator 14 may be a transmissive-type spatial light modulator or a reflective type spatial light modulator. In particular embodiments, spatial light modulator 14 comprises a liquid crystal display (LCD) panel.

In some embodiments, display 10 is a color display and spatial light modulator 14 is a color spatial light modulator. For example, spatial light modulator 14 may comprise separate sets of pixels for each of a plurality of colors. The pixels for each color may comprise optical filters that pass the corresponding color and block other colors. For example, spatial light modulator 14 may comprise sets of red- green- and blue-passing pixels (RGB pixels). RGB pixels are described for example only. Other sets of colored pixels could be provided in the alternative. The pixels may be arranged in any suitable pattern. A Beyer pattern is but one example of a suitable pattern.

In some embodiments, controller 18 is configured to generate one or more additional output signals 24 that control light emitted by backlight 12. Output signals 24 may control one or more of: the overall intensity of light emitted by backlight 12, the spatial distribution of light emitted by backlight 12, one or more color characteristics of light emitted by backlight 12 or the like.

In the illustrated example embodiment, backlight 12 comprises an array of individually-controllable light sources 30. Each of light sources 30 may comprise one or more light-emitting elements such as light-emitting diodes (LEDs) or other light-emitting solid state devices. In embodiments comprising individually-controllable light sources 30, output signals 24 may comprise driving signals that can directly or indirectly drive light sources 30 to emit light.

In some embodiments, the light emitted by backlight 12 comprises white light. This may be achieved, for example, by providing light sources 30 that emit light of different colors that combine to yield white light (for example, red-, green- and blue-emitting light sources 30) or by providing individual light sources 30 that produce white light (for example white LEDs).

Some non-limiting examples of general approaches that may be implemented in controller 18 for generating output signals 20 and 24 are described in: WO02/069030 entitled HIGH DYNAMIC RANGE DISPLAY DEVICES; WO03/077013 entitled HIGH DYNAMIC RANGE DISPLAY DEVICES; WO 2006/010244 entitled RAPID IMAGE RENDERING ON DUAL-MODULATOR DISPLAYS; U.S. 61/105,419 filed on 14 Oct. 2008 and entitled: BACKLIGHT SIMULATION AT REDUCED RESOLUTION TO DETERMINE SPATIAL MODULATIONS OF LIGHT FOR HIGH DYNAMIC RANGES IMAGES; which are hereby incorporated herein by reference.

Figure 2A:
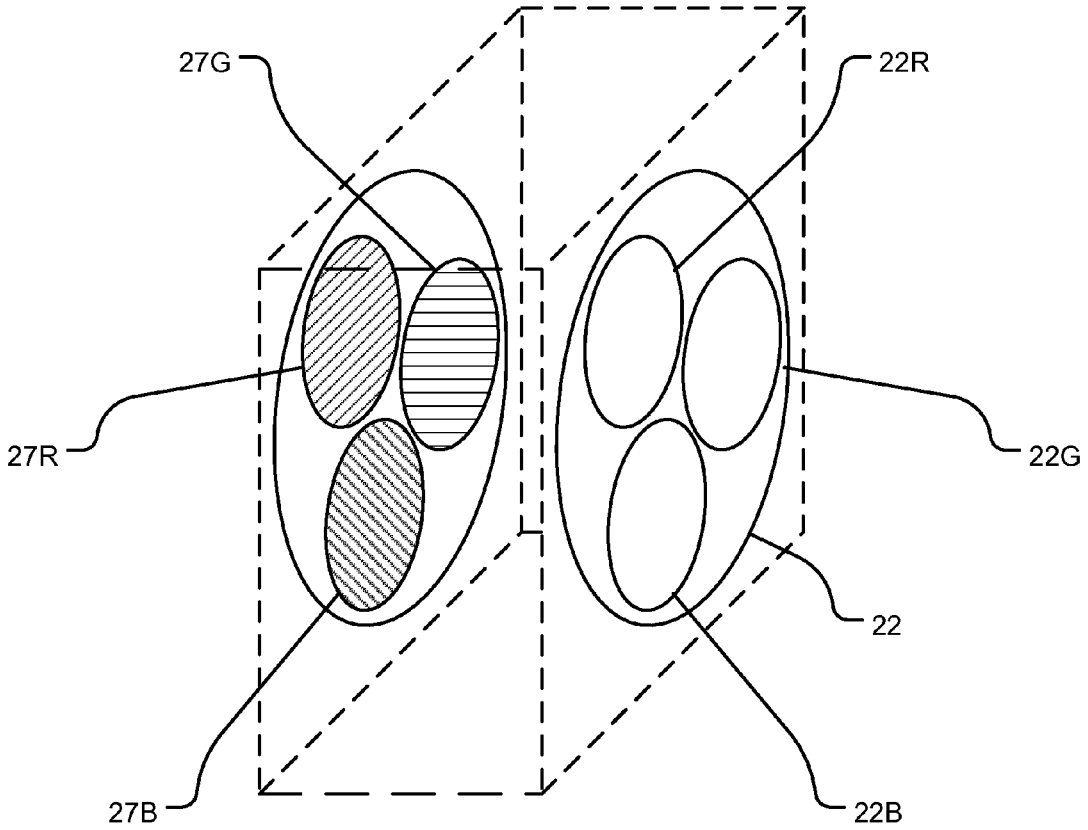
FIG. 2A is a schematic view of a portion of a display like the display of FIG. 1.
Figure 2B:
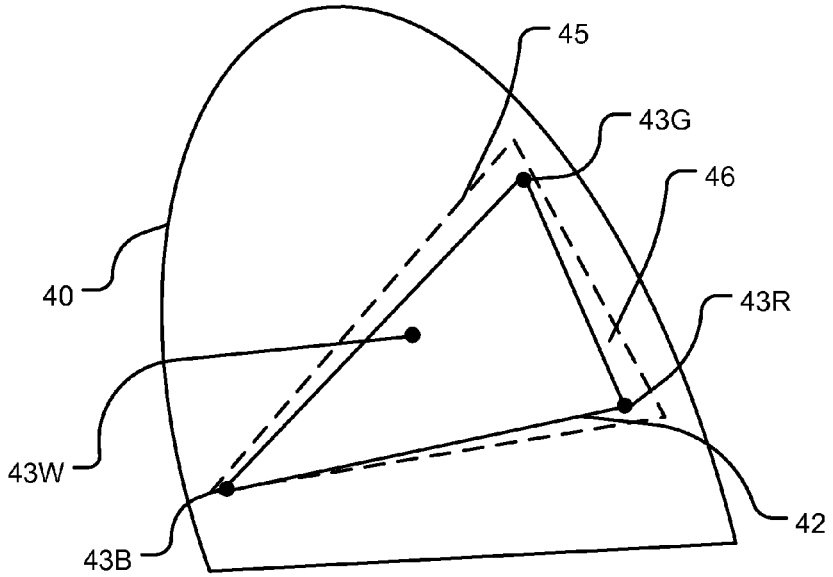
FIG. 2B illustrates a two-dimensional color space.

One issue that can arise in displays of the general types described above is input signals 19 may specify colors for a gamut that does not match the color gamut achievable with display 10. This is illustrated in FIGS. 2A and 2B. FIG. 2A shows a portion of a display 10 at which light from backlight 12 passes through a pixel 22 comprising subpixels 22R, 22G and 22B of spatial light modulator 14. Each subpixel 22R, 22G and 22B has a corresponding color filter; respectively, 27R, 27G and 27B. The light emitted from each of subpixels 22R, 22G and 22B has a spectral composition determined by both the spectral composition of the light emitted by backlight 12 and the properties of the corresponding filter 27R, 27G or 27B.

Another issue that can arise is that if the primary colors that are provided in a display are not the same as the primary colors assumed by the image data then colors produced by the display in response to the image data may not match the color intended by the creator of the image data. This can be the case even where the gamut of the display includes the entire gamut of input signals 19.

FIG. 2B illustrates a two-dimensional color space 40. A gamut 42 contains colors that can be generated by display 10. Points 43R, 43G and 43B are at color coordinates corresponding respectively to the spectra of light emitted by pixels 22R, 22G and 22B of display 10. A white point 43W is at color coordinates corresponding to all of sub pixels 22R, 22G and 22B being driven to their maximum brightness.

Consider the case where input signals 19 specify colors in a gamut 45 that is different from gamut 42. In the illustrated embodiment, gamut 45 includes some colors in a region 46 that cannot be reproduced by display 10 because they are outside of gamut 42. In other embodiments, a display gamut may include colors that cannot be represented in an input gamut. In some embodiments, a display gamut and an input gamut may each include colors that cannot be reproduced by or represented in the other.

Figure 3:
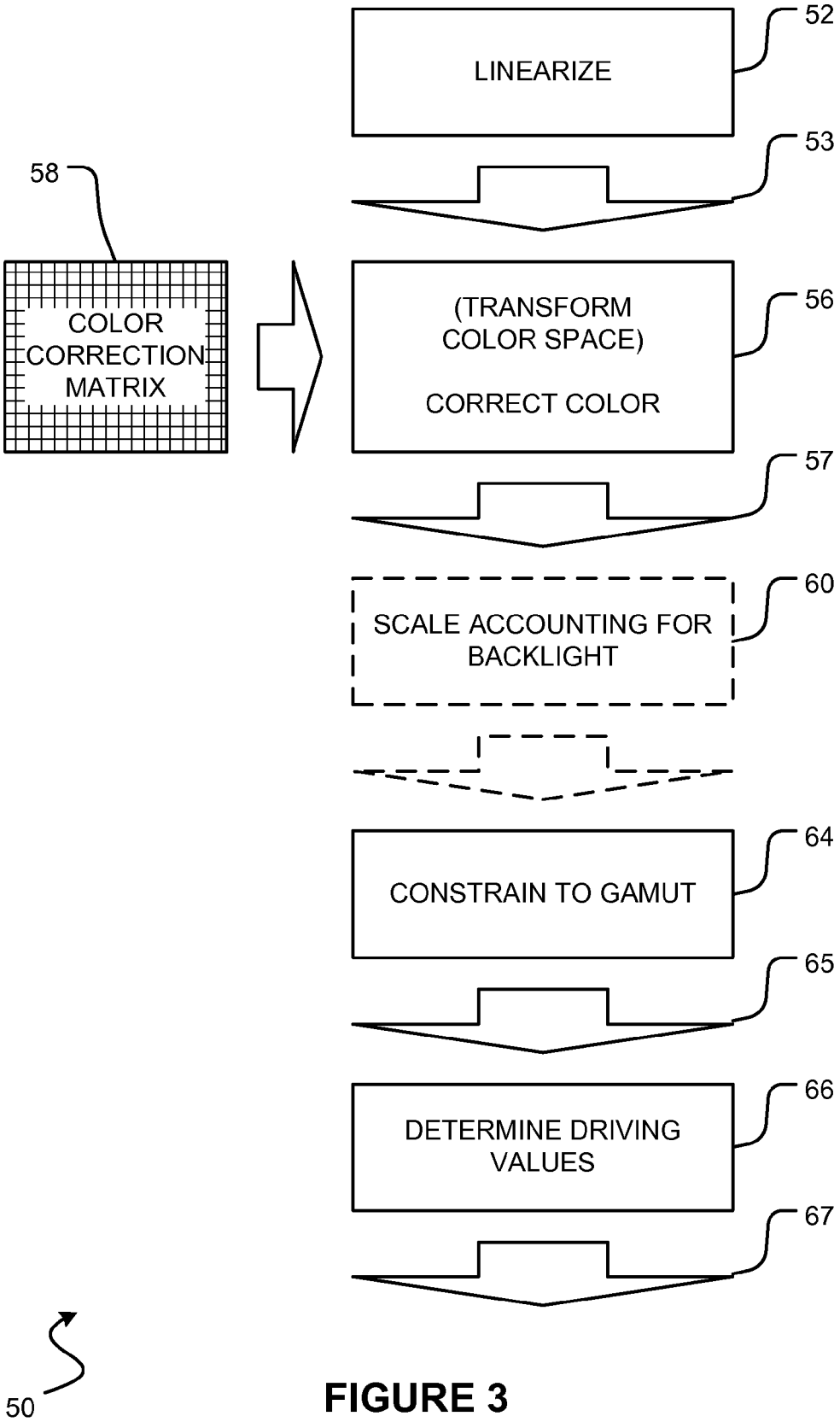
FIG. 3 is a flow chart that illustrates a method according to an example embodiment.

FIG. 3 illustrates a method 50 according to an example embodiment of the invention. Method 50 receives input signals 19 and yields output signals 20. In this example, input signals 19 specify an image on a pixel-by-pixel basis. Signals 19 may, for example, specify pixels in a suitable color space such as, for example, LUV, RGB, YUV, HSV, HSL, xvYCC, and YCbCr color spaces.

In some types of signal that may be provided as input signals 19, luminance values (or other values indicative of brightness or intensity) are encoded according to a non-linear function such as a gamma encoding function. Where this is the case, it is advantageous (although not mandatory in all embodiments) to convert the image data of input signals 19 into a linear space. Typically, the linear space has a greater range than the encoded space. Method 50 has a linearization block 52 which yields linearized image data 53.

In some embodiments, the linearized image data 53 is represented as binary integers having a bit depth greater than that of image data input signals 19. In embodiments where signals 19 have been gamma corrected according to a power function such as:

$$L_{OUT}=L_{IN}^{\gamma} \quad (1)$$

where: LOUT is the luminance value encoded in input signal 19, LIN is the original unencoded luminance value and γ is a parameter then block 52 may comprise applying an inverse of Equation (1). γ has the value of 2.2 in many video formats.

In some embodiments block 52 comprises looking up linearized values in a look-up-table (LUT). For example, if the input signal 19 is in a format that specifies brightness by providing one of a discrete set of possible brightness values (e.g. a byte having bit-values specifying brightness in the range 0 to 255) then block 52 may comprise providing the brightness as a key to a LUT that retrieves a corresponding linearized brightness value.

In some embodiments block 52 comprises applying a boost such that the linearized values are increased. Applying the boost may comprise multiplying by a boost factor. In some embodiments, the boost factor is a constant. In some embodiments the boost factor is a function of the linearized values. For example, the amount of boost may increase for increasing brightness. Where the boost factor is a function of pixel values it is preferred that the same boost factor be applied to all values relating to a pixel to avoid color shifts. For example, where a pixel value comprises a tuple, such as, for example [R,G,B], it is preferable that the same boost factor be applied to all components of the tuple. The boost and linearization may be provided in a combined set of operations or in separate operations.

In some embodiments, the boost may be performed before or without linearization. If boost is performed, the boost may be performed before, after, or in the same step as linearization. In some such embodiments, the range of input signals may be expanded. In some embodiments, boosting and linearization are implemented by providing a look up table. An input signal may be used as a key to retrieve a corresponding boosted and linearized valve.

In an example embodiment, block 52 provides linearized image data 53 in which luminance values are specified by integers. Preferably the integers are sufficiently large that they can represent a large number of discrete luminance values. For example the integers may comprise 31-bit integers. It is desirable that there be sufficient discrete luminance values that the step in luminance obtained by moving to a next luminance value is not noticeable to the eye. In block 56 linearized image data 53 is transformed to a color space appropriate for display 10, if required, and a color correction is applied to yield color corrected data 57. Image data may be required to be transformed where the data specifies an image in a color space that is different from or incompatible with the color space of a destination display. It is not mandatory to perform color space transformation before scaling. Color space transformation may be performed after or in the same step as scaling. Scaling, color space transformation and color correction may be performed together or in any suitable order.

The transformation of block 56 may receive as input a set of color coordinates defined relative to gamut 45 of input data 19 and produce as output color corrected data 57 comprising a set of color coordinates defined relative to gamut 42 of display 10.

The color correction may comprise performing a transformation in a manner which maps a white point 45W of gamut 45 to a desired white point in the gamut 42 of display 38. The transformation may compensate for differences between a spectrum of light emitted by backlight 12 of display 10 and the desired white point, for example. In some embodiments, color transformation and/or color correction may be implemented by performing an affine transformation on the color valves. Such a transformation may skew, scale, and/or rotate colors in a 3-dimensional color space. For example, such a transformation may be expressed as:

$$o=sMi+c \quad (2)$$

where o is an output color vector, i is an input color vector, s is a scaling valve or matrix, M is a transformation matrix, and c is color shift vector. A color shift vector may be added before or after applying transformation matrix M. Color shift is not mandatory.

The color correction may be applied, for example, by performing a matrix operation on linearized image data 53. In the illustrated embodiment, pixel values of linearized image data 53 are multiplied by a color correction matrix 58 to yield corrected image data 57.

In a specific example embodiment, block 56 is implemented by applying a general purpose or customized matrix multiplication facility connected to perform matrix multiplications of color vectors on a per-pixel basis in a stream of image data or to perform a matrix multiplication to image data in a buffer or other memory. The matrix multiplication facility may comprise, for example, a programmed data processor, such as a CPU, GPU, DSP, or the like, a hardware matrix multiplier such as a suitably configured FPGA, logic circuits or the like.

In some embodiments, the color correction in block 56 is performed on a pixel-by-pixel basis and takes into account one or more properties of light incident at pixels from backlight 12, such as, for example, intensity (luminance) and color (chromaticity). In some embodiments the illumination provided by backlight 12 is variable. For example, the overall intensity of light from backlight 12 may be controlled or the light output from backlight 12 may be controlled to vary spatially. Spatial variation in the intensity of light provided by backlight 12 across the pixels of spatial light modulator 14 may be provided, for example, by controlling individually the intensity of light emitted by individual elements of backlight 12. In some such embodiments, spatial light modulator 12 comprises arrays of elements that emit light of different spectral characteristics (e.g. arrays of red- green- and blue-emitting (RGB) light sources or arrays of red- green- blue- and white-emitting (RGBW) light sources). In such embodiments, the color and intensity of light from backlight 12 at pixels may be estimated or determined and the color correction may be based in part on the local color and intensity of the light from backlight 12 at locations on spatial light modulator 14. For example, in some embodiments, the color and intensity of light from backlight 12 at pixels may be estimated from a combination of image data for pixels surrounding or near the pixel and one or more known properties of backlight 12.

The properties may include, for example, point spread functions for light emitters of backlight 12, electro-optical characteristics of light emitters of backlight 12, optical characteristics of optical path 16, combinations thereof, or the like.

For example, generating the estimate may comprise performing a light field simulation. A light field simulation may be performed by taking driving values for individual elements of backlight 12, applying point spread functions that approximate how light from the elements becomes distributed over pixels of spatial light modulator 14 to determine the contributions of one or more elements of backlight 12 at pixels of spatial light modulator 14 and then summing the light contributions of the one or more contributing elements of backlight 12.

In an example embodiment, an estimate of the distribution of light incident from backlight 12 is determined at a resolution that is somewhat greater than (for example twice or four times) the resolution of individuals elements of backlight 12. Per-pixel color at pixels at spatial light modulator 14 is determined in this example embodiment by bi-linear upsampling of the estimated distribution of light.

If block 56 yields values for color coordinates that are outside of a valid range then such values may be replaced with valid values. For example, if block 56 yields any negative values for color coordinates (as could occur in some cases if, for example, the input data 19 specifies a color that is within gamut 45 but outside of gamut 42) and such negative values are not valid for a display being controlled then block 56 may comprise replacing such negative values with non-negative values. For example, any negative values may be replaced with zero or a small positive value.

In some embodiments block 56 may also transform image data to a different image format. The different image format may use the same or a different color space as the original format. By way of example only, linearized image data 53 may express colors in a RGB format and block 56 may perform a conversion such that the output of block 56 provides color corrected data 57 in another format, for example an XYZ format, such a conversion may be combined with or performed separately from other color transformations.

In embodiments where the illumination provided by backlight 12 is variable, block 60 may be provided. Block 60 scales corrected image data 57 (for example, by multiplying or dividing by a factor that varies from pixel to pixel of spatial light modulator 14) in a manner that takes into account the different intensities of light incident on the pixels of spatial light modulator 14.

Block 60 may apply an indication of the intensity and spectral composition of light incident on pixels of spatial light modulator 14. The scaling factor may be based, at least in part, on the indication. The indication may be obtained in various ways, and in some embodiments, the indication comprises an estimate of the intensity and spectral composition of light incident on pixels of spatial light modulator. The estimate may be generated in block 50, or elsewhere, for example where an estimate is determined in block 56 for color correction the same estimate may be used in block 60.

In other embodiments, the indication may be obtained from image data, for example by low-pass spatial filtering the image data, taking an average or weighted average of image data for a local neighborhood of the image or the like. In some embodiments the indication comprises values that vary with the inverses of the intensities of light from backlight 12 at the pixels of spatial light modulator 14. Such embodiments may advantageously perform scaling by multiplying pixel values by corresponding scaling factors. Multiplying can be implemented somewhat more efficiently than dividing in many of the types of hardware that may be applied to implement block 60.

Such scaling may be performed, for example, by applying the general approaches described in:
WO02/069030 entitled HIGH DYNAMIC RANGE DISPLAY DEVICES; WO03/077013 entitled HIGH DYNAMIC RANGE DISPLAY DEVICES; WO 2006/010244 entitled RAPID IMAGE RENDERING ON DUAL-MODULATOR DISPLAYS; and U.S. 61/105,419 filed on 14 Oct. 2008 and entitled: BACKLIGHT SIMULATION AT REDUCED RESOLUTION TO DETERMINE SPATIAL MODULATIONS OF LIGHT FOR HIGH DYNAMIC RANGES IMAGES, all of which are hereby incorporated herein by reference.

In block 64, the corrected image data 59 (or a scaled version thereof in embodiments which include block 60) is constrained to be within the color gamut 42 of display 10. The constraint may be applied, for example, by scaling pixel values of the corrected image data such that the image data does not specify an intensity for any color channel that is greater than an intensity that can be reproduced by display 10. The output of block 64 is gamut-limited data 65.

Consider the case, for example, where the corrected image data is represented in an RGB color format in which values for each of red- green- and blue- sub pixels 22R, 22G and 22B are each specified in a range from 0 to 1. The subpixel value 1 represents the maximum brightness that the corresponding subpixel of display 10 can produce. Where the corrected image data includes one or more subpixel values that are greater than 1, block 64 may comprise scaling the sub-pixel values such that none of the subpixel values exceeds 1. In other cases, maximum brightness sub-pixel brightness may be different for different color subpixels. In some embodiments, this scaling is performed on a pixel-by-pixel basis. In some embodiments, the scaling comprises multiplying all sub-pixel values for a pixel by a common scaling factor.

In embodiments in which the corrected image data is in a format having a brightness or intensity value and one or more color values that specify color (e.g. a YUV format), the scaling of block 64 may comprise multiplying the intensity value by a scaling factor that is a function of the one or more color values.

In block 66 driving values 67 are determined for the pixels of spatial light modulator 14. The driving values 67 may be obtained, for example by looking up coordinate values from gamut-limited data 65 in a suitably configured look-up table or by computing functions of the coordinate values of gamut-limited data 65, or the like. A particular implementation that may be advantageous is described in the U.S. patent application No. 61/105102 filed 14 Oct. 2008 and entitled EFFICIENT COMPUTATION OF DRIVING SIGNALS FOR DEVICES WITH NON-LINEAR RESPONSE CURVES, which is hereby incorporated herein by reference for all purposes.

In some embodiments, block 66 comprises reducing a bit depth of the gamut-limited data to correspond to a resolution of display 10 before determining the driving values 67. Output signals 20 may comprise driving values 67. Driving values 67 may be applied to drive the pixels and sub-pixels of spatial light modulator 14 so as to display an image.

In some embodiments, input signals 19 comprise video data and method 50 is repeated for successive frames of the video data.

Figure 4A:
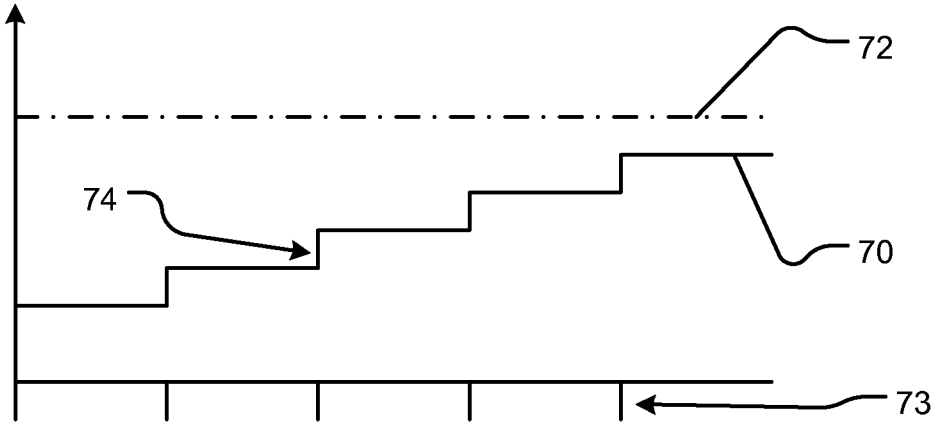
FIG. 4A is a plot which includes a curve representing light intensity as a function of position along some line crossing a portion of an image.
Figure 4B:
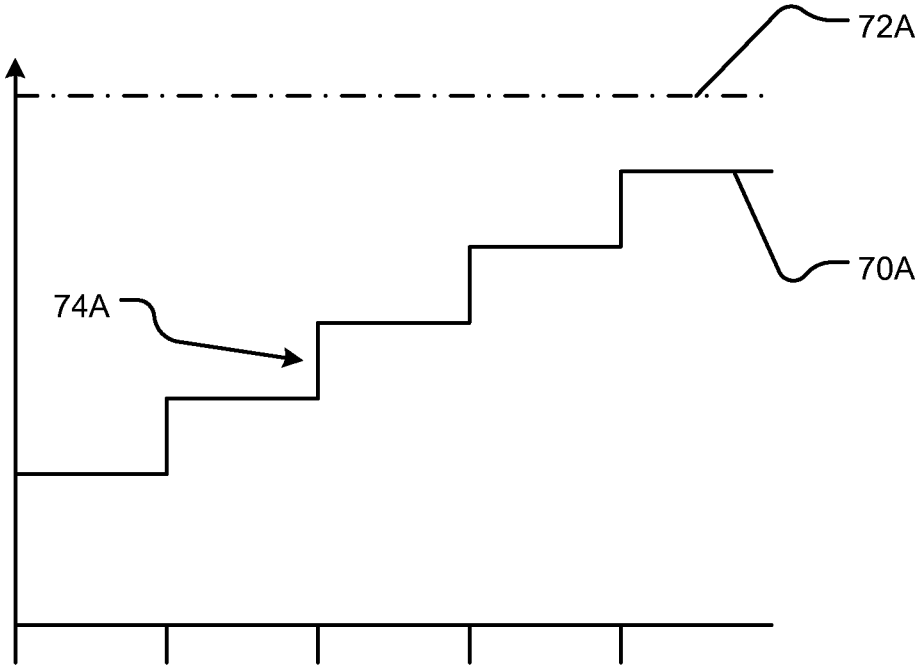
FIG. 4B is a plot similar to FIG. 4A for the case where a boost has been applied to the same image data.
Figure 4C:
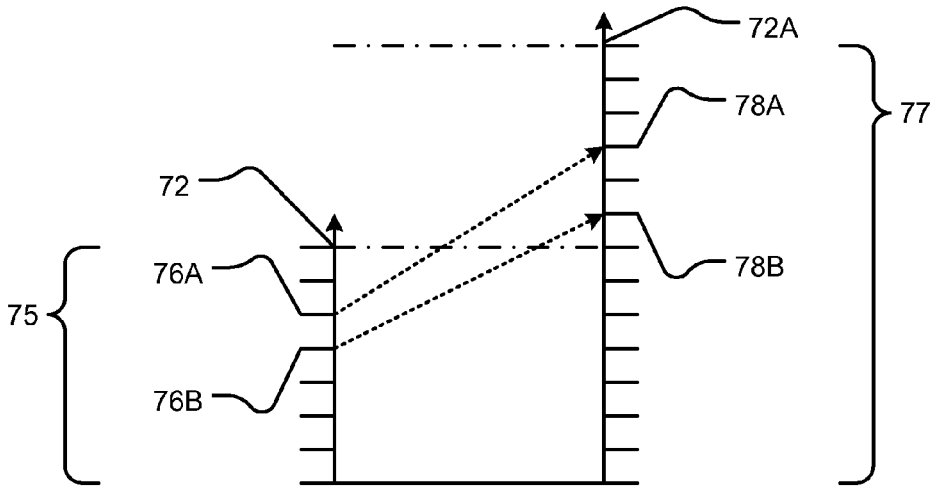
FIG. 4C illustrates a mapping of original image data into a color space in which a greater intensity is permitted in a manner that includes boosting.

FIGS. 4A, 4B and 4C illustrate a condition that may be encountered in cases where a boost is applied to image data. This condition can be a particular issue in cases where display 10 comprises a high dynamic range display. FIG. 4A is a plot which includes a curve 70 representing light intensity as a function of position along some line crossing a portion of an image specified by some original image data. A maximum possible intensity is indicated by line 72. The edges of pixels are indicated by vertical lines 73. In this example, the light intensity increases gradually from left to right. The amounts by which light intensity changes at steps 74 where the light intensity changes from one pixel to the next may be so small that they are not noticeable. A viewer may perceive the light intensity varying smoothly over the area corresponding to curve 70.

Consider the case where the original image data is boosted and mapped into a color space in which a greater intensity 72A is permitted as shown, for example, in FIG. 4C. In FIG. 4C a number of discrete intensity values 75 are mapped into corresponding values from among a larger number of discrete intensity values 77. As a result of the mapping, non-zero intensity values are boosted. As a consequence two adjacent intensity values 76A and 76B, which correspond to light intensities that may appear the same or very similar when viewed, are mapped to corresponding intensity values 78A and 78B, which correspond to light intensities that differ from one another by a greater amount. The light intensities corresponding to intensity values 78A and 78B may be noticeably different, when viewed.

Figure 4D:
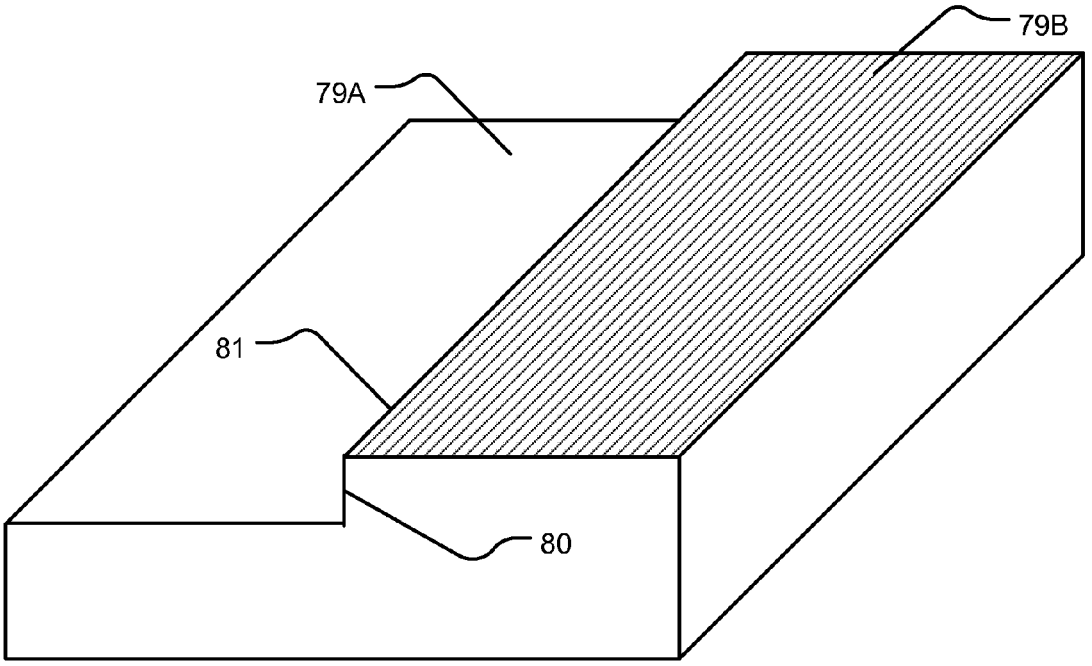
FIG. 4D is an example contour plot illustrating a variation of light intensity over a portion of an image.

The result of a boost is illustrated in FIG. 4B which shows the same image data as in FIG. 4A after boosting. It can be seen that steps 74A in FIG. 4B are larger than steps 74 of FIG. 4A. Such larger steps may result in visible contrast artefacts, such as lines across portions of an image, especially in images which include large areas of gradually varying intensity. FIG. 4D, for example is a contour plot that illustrates a portion of an image in which pixels have a first intensity in an area 79A and a second intensity that is one step greater than the first intensity in an adjacent area 79B. The intensity increases at a step 80 which forms a line 81 along the boundary between the first and second areas 79A and 79B. Line 81 extends through a region of the image. Such lines can be particularly noticeable to the human visual system (HVS).

Some embodiments of the invention apply a method to mitigate artefacts resulting from conditions such as those illustrated in FIGS. 4A to 4D. In such embodiments, a small amount of dither is applied to the image data to break up lines like line 81 and render such lines less noticeable.

In some embodiments, introducing dither comprises randomly or quasi-randomly adding or subtracting small amounts from pixel values. In some embodiments the small amounts added or subtracted are smaller than the differences between adjacent values for a display. The addition and subtraction of these small amounts may cause pixels that would otherwise have the same intensities to have intensities that are different.

Consider the following specific example. In this example, driving values 67 for the pixels of a display 10 are specified as binary numbers having some suitable number of bits, for example 10 bits. The method involves representing the driving values 67 as 11-bit numbers in which the value for the lowest-order bit is set randomly (including quasi-randomly). The 11-bit numbers are then rounded to provide the 10-bit driving values 67 used to drive pixels of display 10. The random addition of a lowest-order bit followed by rounding introduces a fuzziness into lines like line 81 that could form in image regions where the intensity changes slowly.

The general approach of randomly adding or subtracting a small amount from pixel values and then rounding is not limited to applications in which pixel values are expressed in a binary representation. A similar approach can be applied to provide dithering where pixel values are expressed as decimal numbers, for example.

Consider another specific embodiment in which pixel driving values are expressed as decimal integers in the range of 0 to 100. Small decimal values (for example values of magnitude less than 1) may be randomly added to or subtracted from the pixel driving values and then the pixel driving values may be rounded to the nearest integer. A simple way to implement such a scheme is to provide an array of such small numbers and to take the pixel driving values in sequence and each time add to the pixel driving value the value of the next element in the array. If the array has N entries then every Nth pixel driving value will have the same amount added to it. However, if N is more than a few and N is suitably chosen then the result will not be noticeably different from the addition of small amounts at random.

For example, the array may have a prime number of elements such as 7 or 11 in some embodiments. The following 7-element array could be applied, for example: {0; 0.25; −0.5; 0.25; 0; 0.5; −0.25}.

In some embodiments, introducing dither may comprise multiplying or dividing pixel values by random or quasi-random amounts near one.

Small random variations could also conveniently be introduced to pixel values when linearizing and/or boosting input data, for example in block 52 of method 50. Where the linearized pixel values are expressed in a manner that provides a larger number of discrete possibilities than the original data, some randomness may be introduced while or after performing the linearization.

Applying small random variations to pixel values (in some embodiments variations that are below a quantization threshold) may be performed in contexts that do not perform color correction or others of the steps described above.

Figure 5A:
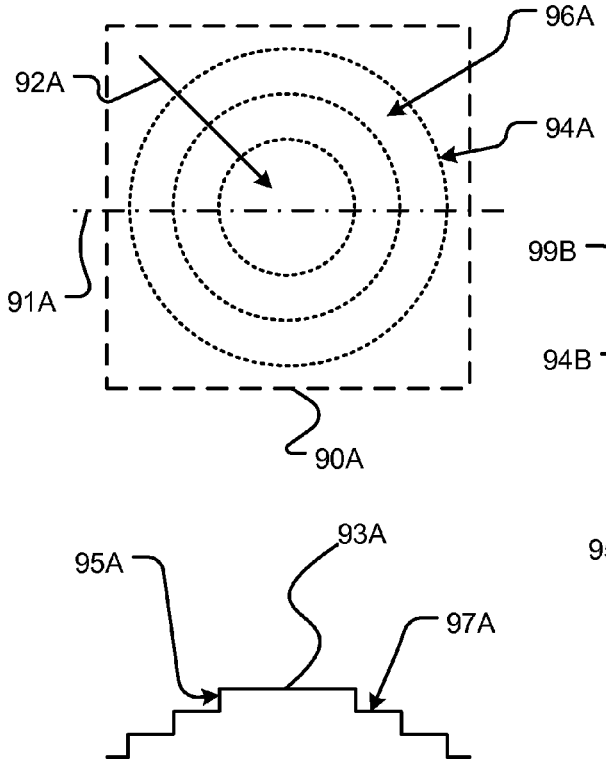
FIG. 5A shows a schematic illustration of an image.

FIGS. 5A, 5B, 5C, 6A and 6B illustrate the mitigating effect of introducing dither on visible contrast artefacts. FIG. 5A shows a schematic illustration of an image 90A. Image 90A comprises a radial gradient feature. Arrow 92A is normal to contours of the radial gradient feature. Boundaries 94A lie along contours of the gradient feature and demarcate regions 96A of contiguous pixels having the same value. Curve 93A indicates the values of pixels (not shown) along line 91A. Steps 95A correspond to boundaries 94A. Plateaus 97A correspond to regions 96A. The gradient feature of image 90A is gradual. Pixels in adjacent regions 96A of image 90A differ by only a small amount. As a result, boundaries 94A are not perceptible to a human vision system as visible lines.

Figure 5B:
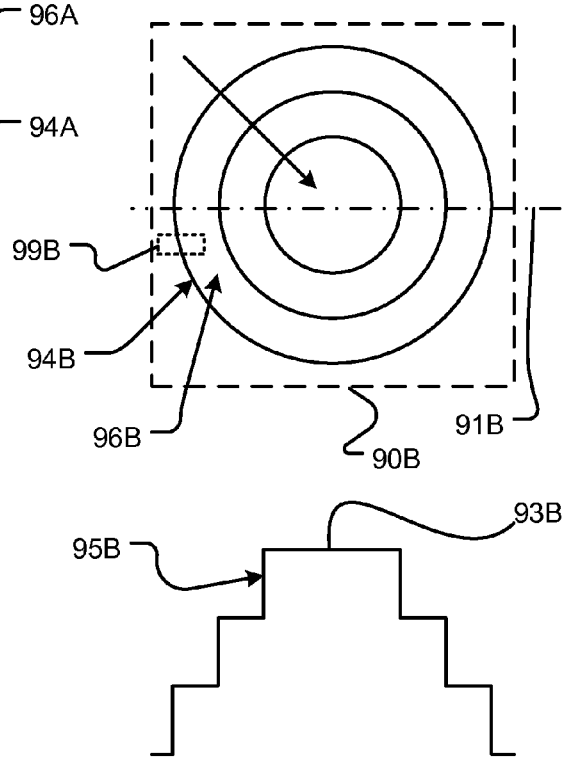
FIG. 5B shows a schematic illustration of an image.

FIG. 5B shows a schematic illustration of image 90B. Image 90B is the same image as image 90A after boosting. As a result of boosting, the gradient feature of image 90B is less gradual than the gradient feature of image 90A. Pixels in adjacent regions 96B of image 90B differ by a larger amount than pixels in adjacent regions 96A of image 90A. This is shown in curve 93B, which indicates the value of pixels (not shown) along line 91B. Steps 95B on curve 93B are larger than the corresponding steps 95A on curve 93A. As a result, boundaries 94B are perceptible to a human vision system as visible lines, and the gradient feature exhibits an effect known as "banding".

Figure 5C:
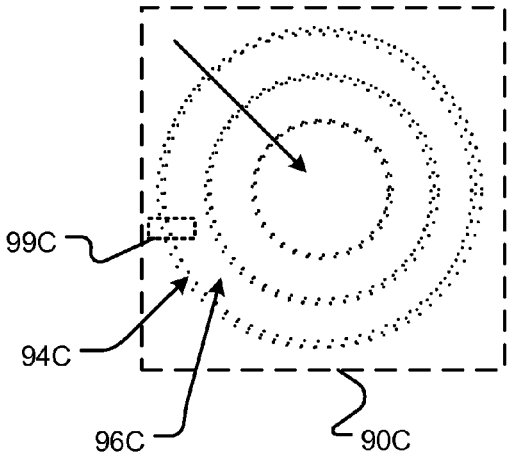
FIG. 5C shows a schematic illustration of an image.

FIG. 5C shows a schematic illustration of image 90C. Image 90C is the same image as image 90B after dither has been introduced. The introduction of dither causes boundaries 94C between regions 96C to be diffuse. As a result, a human vision system may not perceive boundaries 94C as visible lines, and may not perceive regions 96C as bands.

Figure 6A:
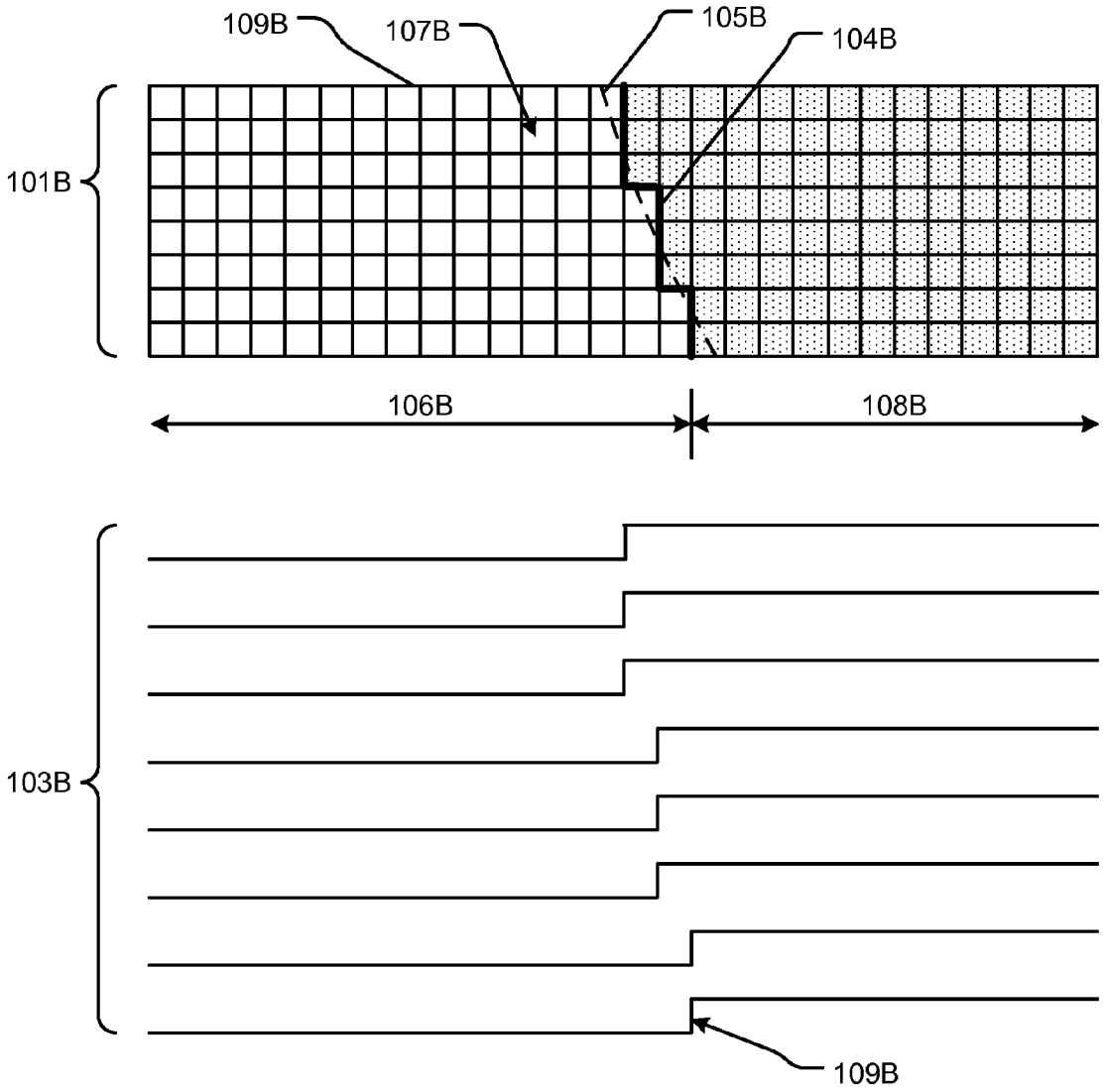
FIG. 6A shows a schematic illustration of a region of an image.
Figure 6B:
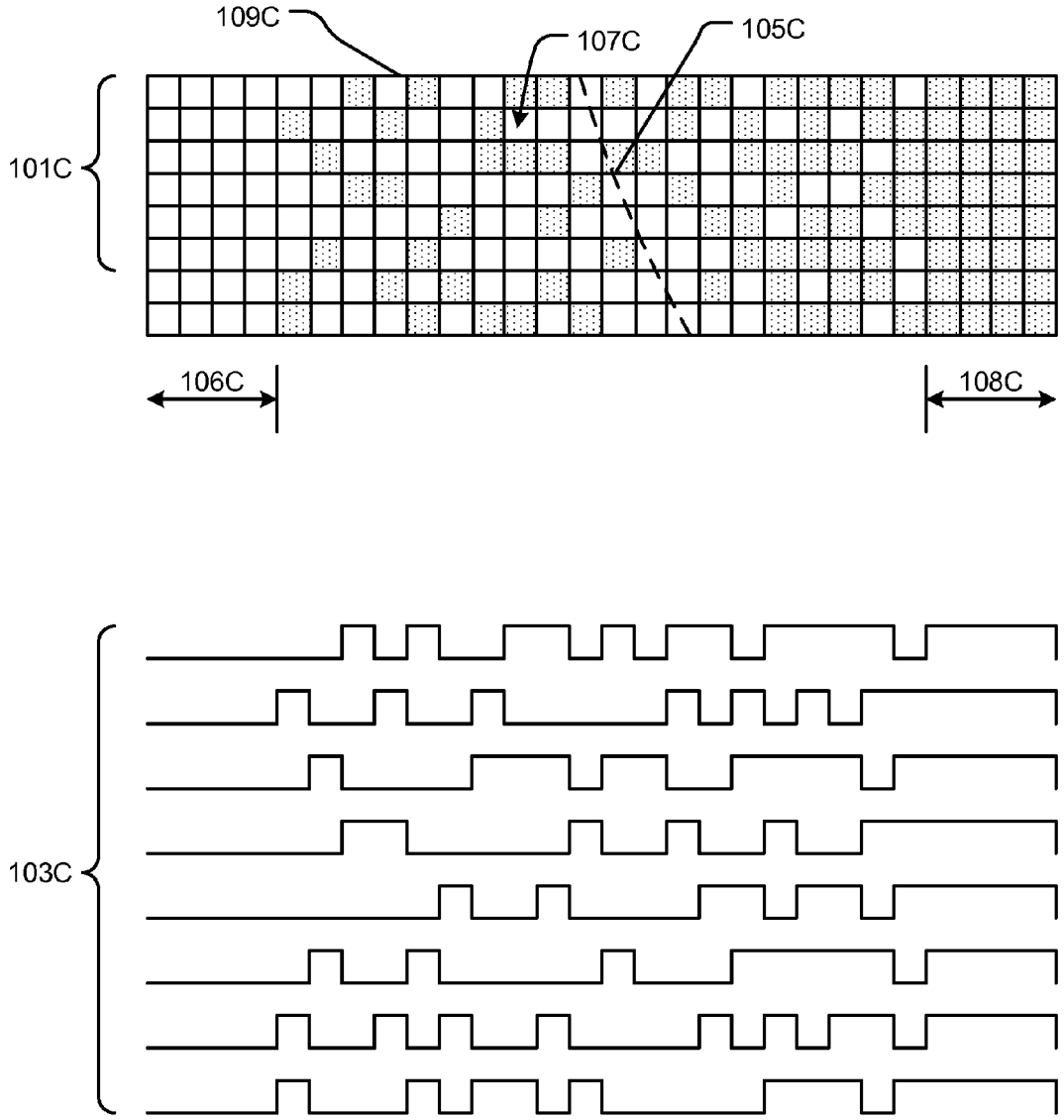
FIG. 6B shows a schematic illustration of a region of an image.

FIG. 6A and 6B illustrate the application of dithering to pixel image data. FIG. 6A shows a close-up view 109B of region 99B of image 90B. Curve 105B is a contour of the gradient of image 90B. Image 90B comprises pixels 107B. Curves 103B indicate the values of the pixels in rows 101B. Steps 109B correspond to boundaries between pixels in a row that have different values. Each of curves 103B comprises a single step 109B. Collectively, steps 109B correspond to boundary 104B. Boundary 104B corresponds to the part of boundary 94B within region 99B, and approximates contour 103B. Boundary 104B defines a sharp transition between regions 106B and 108B. This may cause boundary 104B to be perceived as a visible contrast artefact, and cause regions 106B and 108B to be perceived as bands.

FIG. 6B shows a close-up view 109C of region 99C of image 90C. Curve 105C is a contour of the gradient of image 90C. Image 90C comprises pixels 107C. Curves 103C indicate the values of the pixels in rows 101C. Each of curves 103B comprises several steps 109B. This causes the boundary between regions 106C and 108C to be diffuse. As a result, a human visual system may not perceive the boundary between regions 106C and 108C as a visible contrast artefact, and may not perceive regions 106B and 108B as bands.

Certain implementations of the invention comprise computer processors which execute software instructions which cause the processors to perform a method of the invention. For example, one or more processors in a display or in a system that generates driving signals for a display may implement the method of FIG. 3 by executing software instructions in a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Figure 7:
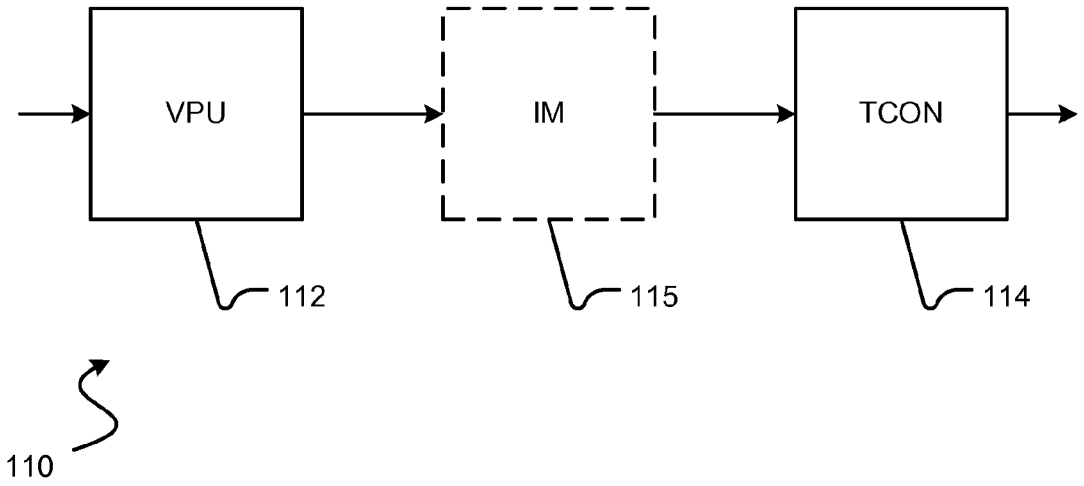
FIG. 7 is an signal path of a system according to an example embodiment.

The invention may also be implemented in suitably configured logic circuits such as suitably configured field-programmable gate arrays and/or hard-wired logic circuits. In an example embodiment, such logic circuits are provided in a timing controller board (TCON) for a panel display such as an LCD panel or in an image (or video) processing board or in an intermediate system imposed in a signal path between an image processing component and a TCON. FIG. 7 shows an example signal path 110 comprising a video processing unit 112, a TCON 114 and an intermediate module 115 connected between video processing unit 112 and TCON 114. Also schematically illustrated in FIG. 7 are possible locations 95 for logic circuits or processors that implement methods of the invention.

Figure 8:
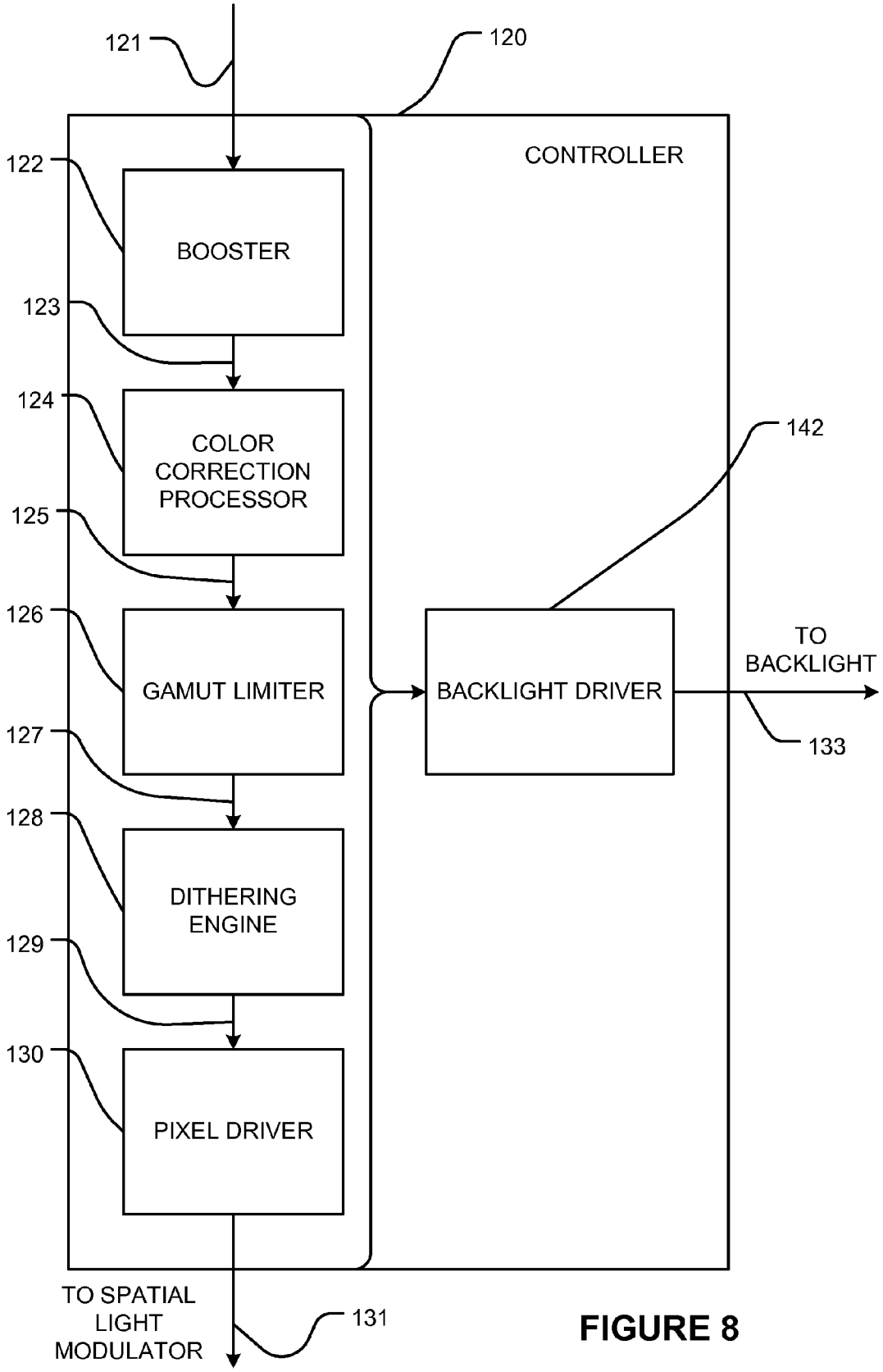
FIG. 8 is a schematic illustration of a controller according to an example embodiment.

FIG. 8 is a schematic illustration of a controller 120 according to an example embodiment. An image data booster 122 is connected to receive image data 121. A color correction processor 124 is connected to receive boosted image data 123 that has been processed by image data booster 122. A gamut limiter 126 is connected to receive color corrected image data 125 that has been processed by color correction processor 124. A dithering engine 128 is connected to receive gamut limited image data 127 that has been processed by gamut limiter 126. A pixel driver 130 is connected to receive dithered image data 129 that has been processed by dithering engine 128, and output pixel driving values 131. A backlight driver 132 supplies backlight driving signals 133. Backlight driver 132 may be connected to receive input image data 121, boosted image data 123, color corrected image data 125, gamut limited image data 127, dithered image data 129, pixel driving values 131, combinations thereof, or the like.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method for adapting image data to a high dynamic range display, wherein the image data is specified for an input gamut with a range that is lower than the range of a display gamut of the high dynamic range display, the method comprising:

applying a boost to the image data, wherein the image data is expanded to the range of the high dynamic range display, and wherein the image data comprises pixels and applying a boost to the image data comprises scaling the pixels according to their brightness by a boost factor, the boost factor being a function of the pixel values such that the boost factor increases for increasing brightness of the pixel values;

dithering the boosted image data, comprising:

applying a variation to values of a plurality of the pixels wherein a pixel value changes differently compared to a neighboring pixel value so as to reduce artifacts along boundaries within the image data, wherein the artifacts between neighboring pixels are introduced by applying the boost to neighboring pixel values to achieve the expanded high dynamic range of the display; and rounding the value of the one or more pixels;

color correcting the image data specified for the input gamut to a display gamut by performing a transformation on the color values and performing an affine transformation on color values according to the expression $0=sMi+c$; wherein O is an output color vector, i is an input color vector, s is a scaling value; M is a transformation vector and c is a color shift vector;

constraining the image data to the display gamut, wherein the constrained image data does not specify an intensity for any color channel that is greater than an intensity that can be reproduced by the high dynamic range display.

2. A method according to claim 1, wherein color correcting the image data comprises separately color correcting at least two pixels specified by the image data.

3. A method according to claim 2, comprising determining one or more properties of light from a backlight incident near the location at which the pixel is displayed on the display and color correcting the pixel is based at least in part on the one or more properties.

4. A method according to claim 1, wherein the variation is a random or quasi-random value.

5. A method according to claim 1, wherein the variation is smaller than a quantization threshold of the image data to be dithered.

6. A method according to claim 1, wherein the variation is smaller than a difference between the value of the one or more pixels and the value of one or more pixels adjacent to the one or more pixels.

7. A method according to claim 1, wherein applying a boost to the image data comprises using the image data as a key to retrieve a boosted and linearized value from a look-up table.

8. A method according to claim 1, wherein the pixels of the boosted image data are specified by 31 bit integer luminance values.

9. A method according to claim 1, wherein the bit depth of the display gamut limited image data is reduced to correspond to a resolution of the high dynamic range display.

10. A controller for a high dynamic range display configured to perform the method according to claim 1.

11. A high dynamic range display comprising:

a spatial light modulator;

a backlight operable to emit light incident on the spatial light modulator; and the controller according to claim 10, and configured to generate driving values for pixels of the spatial light modulator;

wherein the controller produces a dithering of the driving values comprising a diffusion of boundaries between regions of an image to be displayed.

12. A high dynamic range display, comprising:

a dual modulation architecture comprising first and second spatial light modulators, the first spatial light modulator comprising a backlight configured to produce spatially modulated light to illuminate the second spatial light modulator;

a controller configured to produce, a backlight signal configured to cause energization of the backlight in a manner to produce the spatially modulated light, and a second spatial light modulator signal configured to cause energization of the second spatial light modulator, the controller comprising:

a boost processor configured to expand input image data to a high dynamic range of the display, wherein the expansion comprises scaling the pixels according to their brightness by a boost factor, the boost factor being a function of the pixel values such that the boost factor increases for increasing brightness of the pixel values;

a color correction processor configured to transform a gamut of image data to a gamut of the high dynamic range display and configured to perform an affine transformation on color values according to the expression $O = sMi + c$; wherein O is an output color vector, i is an input color vector, s is a scaling value; M is a transformation vector and c is a color shift vector;

a gamut limiter configured to constrain the image data to the display gamut, wherein the constrained image data does not specify an intensity for any color channel that is greater than an intensity that can be reproduced by the high dynamic range display; and a dithering engine configured to dither the image data that has been boosted by the boost processor in a manner that reduces artifacts in display of the image data caused by the boost;

wherein the backlight signal and second spatial light modulator signal are based on the boost processed expanded image data, and a product of the dithering engine is used to produce the second spatial light modulator signal and wherein the reduction in artifacts includes a reduction in artifacts among a plurality of pixels dithered along at least one boundary within the image data; and wherein the artifacts between neighboring pixels are introduced by applying the boost to neighboring pixel values to achieve the expanded high dynamic range of the display.

13. The high dynamic range display according to claim 12, wherein the dithering engine further configured to at least one of apply a variation and round at least one value of the pixels.

14. The high dynamic range display according to claim 12, wherein the color correction processor transform comprises an affine transformation on color values of the image data.

15. The high dynamic range display according to claim 12, wherein the same boost factor is applied to all components of a pixel value.

16. The high dynamic range display according to claim 12, wherein the boost and a linearization of pixels values is performed via a look-up table.

17. The high dynamic range display according to claim 12, wherein the boost processing is performed in steps of luminance such that adjacent steps do not generate a noticeable difference to the eye.

18. The high dynamic range display according to claim 12, wherein the transform comprises at least one of skewing, scaling, and rotation of colors in a 3-dimensional color space.

19. The high dynamic range display according to claim 12, wherein color correction is configured to be performed so as to take into account one or more properties of light incident at pixels from backlight.

20. The high dynamic range display according to claim 19, wherein color correction is performed on a pixel-by-pixel basis.

* * * * *